US006299376B1

(12) United States Patent
Nakatani

(10) Patent No.: US 6,299,376 B1
(45) Date of Patent: Oct. 9, 2001

(54) BALL-POINT PEN

(75) Inventor: Yasunori Nakatani, Amagasaki (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/660,090

(22) Filed: Sep. 12, 2000

(30) Foreign Application Priority Data

Sep. 13, 1999 (JP) ..... 11-258189

(51) Int. Cl.[7] ..... B43K 7/10
(52) U.S. Cl. ..... 401/215; 401/209
(58) Field of Search ..... 401/209, 208, 401/210, 212, 215

(56) References Cited

U.S. PATENT DOCUMENTS 3,166,050 * 1/1965 Fehling et al. ..... 401/215
4,150,905 * 4/1979 Kaplan et al. ..... 401/215
4,621,936 * 11/1986 Hansson et al. ..... 401/215
4,653,950 * 3/1987 Yoshida ..... 401/215

* cited by examiner

*Primary Examiner*—David J. Walczak
(74) *Attorney, Agent, or Firm*—Howard C. Miskin; Gloria Tsui-Yip

(57) ABSTRACT

A ball-point pen comprising:

a. a penpoint tip, b. a writing ball rotationally held in the penpoint tip and c. an ink reservoir whose distal end is connected to the penpoint tip, wherein the writing all is formed of a sintered inorganic material having a surface layer comprising fine holes that have a median diameter of from about 1 to about 20 $\mu$m, and the ink reservoir is filled with an aqueous ink containing a glass flake pigment and having a viscosity of about 4,000 to about 30,000 mPa·S.

15 Claims, 1 Drawing Sheet

BALL-POINT PEN

FIELD OF THE INVENTION

The present invention relates to a ball-point pen.

BACKGROUND OF THE INVENTION

Ball-point pens are well known and widely used as writing tools, and each comprises a writing ball rotationally held in a penpoint tip. An ink filled in an ink reservoir fixed in the ball-point pen will be guided in use to the writing ball so as to be transferred to a paper sheet, or the like, as the ball rotates. Usually employed as a material for forming writing balls in ball-point pens are zirconia, stainless steel or tungsten.

Recently, some types of novel aqueous ink compositions have been proposed, and bright pigments contained therein have been intended to give golden, silver-colored or any other metallic-colored writings. For example, an aluminum pigment containing aqueous ink is disclosed in the Japanese Patent Laying-Open Gazette Hei No. 7-118592. A pearl-glossy pigment containing aqueous ink is disclosed in the Japanese Patent Laying-Open Gazette Hei No. 8-151547. An aqueous metallic-colored ink disclosed in the Japanese Patent Laying-Open Gazette Hei No. 11-29734 comprises an aluminum pigment whose particles are coated with an organic pigment particles by means a fixing agent.

However, it has not necessarily been easy to achieve sufficiently intensive brilliancy and stereoscopic feeling in the writings or membranes formed of such prior art aqueous inks containing the afore-said aluminum pigment or pearl-glossy pigment. Further, a resin material or the like used to fix a colorant (viz., dyestuff molecules or pigment particles) on the described basic pigment to realize a metallic luster has also caused a poor brilliancy.

In view of these problems, the present applicant has already proposed in its Japanese Patent Application No. 11-76868 an improved type of brilliant aqueous ink composition. This composition was characterized by a glass flake pigment that would provide, in addition to brilliancy higher than those given by any known aqueous inks comprising conventional pigments, an intensive stereoscopic feeling that had not been realized by the prior art aqueous inks.

Particle diameter of such a glass flake pigment is comparatively large so that a higher viscosity of ink would possibly cause certain incontinuity in the writings, if the known ordinary writing ball were used.

SUMMARY OF THE INVENTION

It is desirable to provide an improved novel type of ball-point pen that writings can be made generally free from unintentional broken lines, even in use with a brilliant aqueous ink comprising a glass flake pigment.

Such improved ball-point pen may be provided by a ball-point pen comprising a. a penpoint tip, b. a writing ball rotationally held in the penpoint tip and c. an ink reservoir whose distal end is connected to the penpoint tip, wherein the writing ball is formed of a sintered inorganic material having a surface layer comprising fine holes that have a median diameter of from about 1 to about 20 $\mu$m, and the ink reservoir is filled with an aqueous ink containing a glass flake pigment and having a viscosity of about 4,000 to about 30,000 mPa·S.

BRIEF DESCRIPTION OF THE PREFERRED EMBODIMENTS

Figure 1:
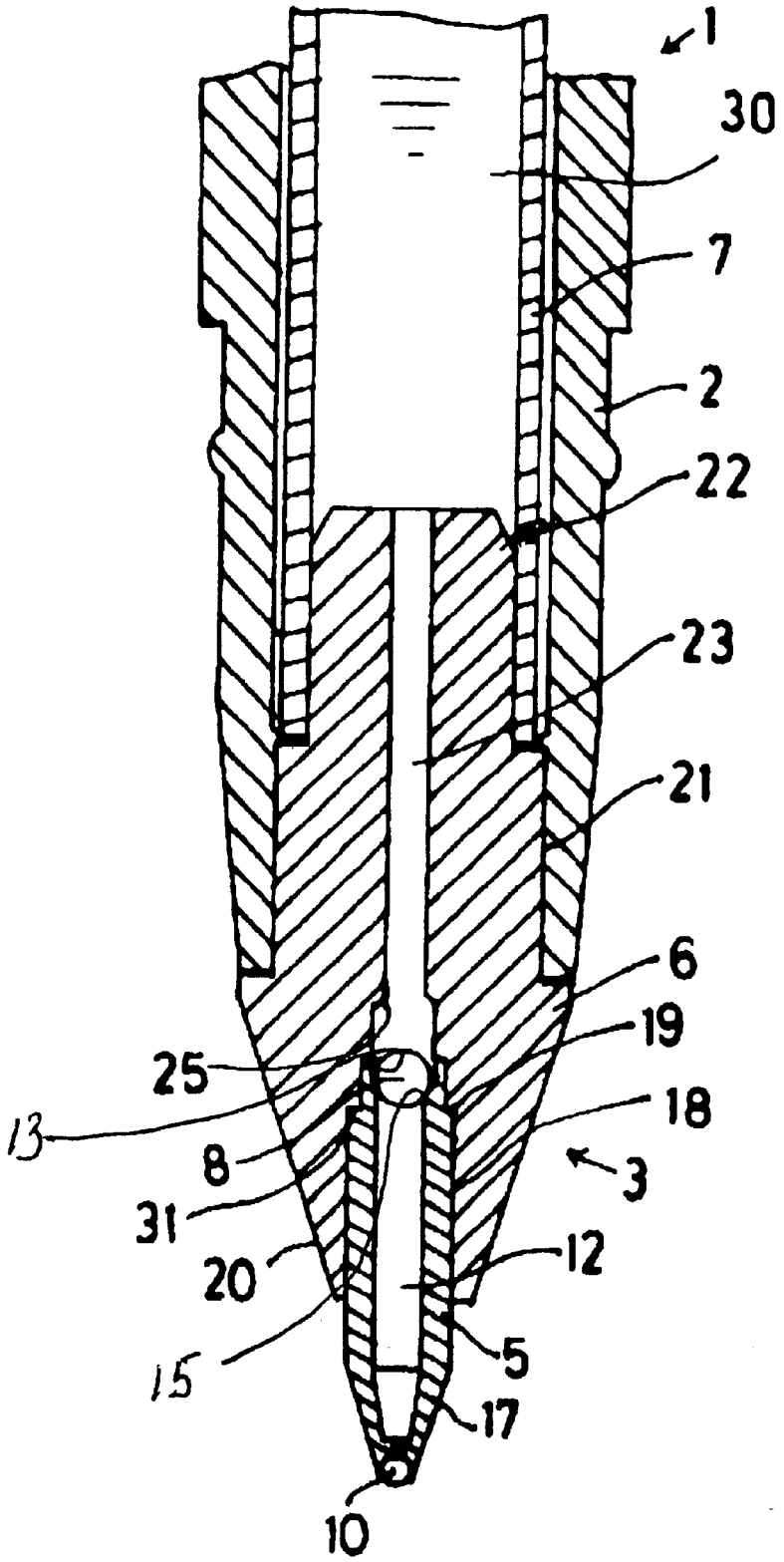
FIG. 1 is a cross section of the principal part of a ball-point pen provided in an embodiment of the present invention.

A ball-point pen of the present invention comprises a penpoint tip having a writing ball rotationally held therein and an ink reservoir whose distal end is connected to the penpoint tip. This pen is however characterized in that its writing ball is formed of a material selected from the group consisting of sintered siliconcarbide, sintered zirconia, sinted alumina and sintered silicon nitride. The writing ball has in its spherical surface layer a number of fine holes having a median diameter of from about 1 $\mu$m to about 20 $\mu$m, preferably from 1 to 20 $\mu$m. The ink reservoir is preferably filled with an aqueous ink that contains a glass flake pigment and has a viscosity of from about 4,000 to about 30,000 mPa·S, preferably from 4,000 to 30,000 mPa·S.

The writings made using this pen will be highly brilliant and stereoscopic as compared with those obtained in use of known aluminum pigments or pearl-glossy pigments. This visual effect results from a highly smooth surface of each particle of the glass flake pigment. The glass flake pigment will render the ink highly viscous. However, the writing ball made of the sintered material having a porous surface of fine holes having the median diameter of 1–20 $\mu$m will be effective to avoid any inconvenience caused by such a high viscosity. In detail, the fine surface pores will function to keep the writing ball wetted with the aqueous ink, thus facilitating the aqueous ink to flow out of the penpoint tip while letting the writing ball rotate smoothly. By virtue of this feature, any unintentional broken lines would now preferably not be produced in the writings.

Preferably, content of the glass flake pigment may be from about 0.5 to about 20.0% by weight of the ink composition, preferably from 1.0 to 20.0% by weight the ink composition. If the content is less than 1.0%, then the ink will give an insufficient brilliancy and stereoscopic feeling. If the content exceeds 20.0%, then an excessively high viscosity will impair flowability of the ink. Thus, an optimal content of the glass flake pigment is from 2.0 to 10.0% by weight of the ink.

The aqueous ink may further contain therein a water-soluble resin, a water-soluble organic solvent and a colorant or colorants, all dissolved or dispersed in water. Content of the water-soluble resin is preferably from 0.01 to 40.0% by weight of the ink. If this content is less than 0.01%, then the pigment will not be protected well from depositing. If said content is higher than 40.0%, then an excessively high viscosity will bring about an insufficient flowability of the ink. Thus, an optimal content of the water-soluble resin is from 0.05 to 20.0% by weight of the ink.

As for the glass flake pigment, glass flakes of the pigment are preferably coated each with a metal or a sub-metallic material that may be formed thereon, such as by the non-electrolytic plating or sputtering method. The glams flake pigment comprises a glass flake coated with one or more of the group of gold, silver, copper, brass, titanium, nickel, chronnum and molybdenum, and/or one or more of the group of bismuth, antimony and arsenic. Median diameter of those flakes is considerably greater than those in the usual pigments so as to ensure brilliancy. A median diameter of those flakes may preferably be from 5 to 40 $\mu$m, and a maximum diameter in distribution of diameter values may be about 200 μm. In a preferable mode of the present invention, the ball-point pen comprising the penpoint tip with the writing ball rotationally held therein and the ink reservoir whose distal end is connected to said tip is characterized in that its writing ball is formed of the sintered inorganic material having the surface layer of fine holes that have a median diameter of from 1 to 10 μm. The ink reservoir is filled with the aqueous ink containing the glass flake pigment and having a viscosity of from 4,000 to 30,000 mPa·S.

The material forming the writing ball may be selected from the group consisting of sintered silicon carbide, sintered zirconia, sintered alumina, and sintered silicon nitride. In case of a sintered alumina, its purity is preferably 99.8% by weight or higher, and its apparent density is desirably 3.8 g/cubic cm or higher. Sintered silicon nitride may be said material. It is possible to add to the glass flake pigment in the aqueous ink, any further pigment or pigments selected from the group consisting of brilliant pigments, such as metal-coated inorganic pigments; metal-luster pigments, such as an aluminum powder; peal-glossy pigments; white pigments, such as titanium dioxide powder, and the like. The 'metal-coated inorganic pigments' include herein those pigments which are coated each with a metal or a metal oxide. The aqueous ink in the present invention may be prepared by blending in water the pigments with a water-soluble resin, a water-soluble solvent, a colorant and the like, if necessary.

The described brilliant aqueous ink composition containing the glass flake pigment is advantageous in that an intensively brilliant and stereoscopic appearance is imparted to the writings by virtue of flat and smooth surfaces of glass flakes. Further, the inorganic pigment colored with a metal coat that may be formed on each pigment particle by the vapor deposition, or the like method, may be used herein in addition to and in combination with such a glass flake pigment. In this case, brilliant feeling will be enhanced much more in appearance of the writings or membranes formed of this ink, in good contrast with the prior art aqueous inks simply containing the conventional brilliant pigments.

Now, the ingredients of the aqueous ink will be detailed below.

Glass Flake Pigment.

Glass flakes of this pigment are coated with a metal or a sub-metallic material rendering it capable of producing brilliancy and stereoscopicity. The sub-metallic material may be bismuth, antimony, gray arsenic or the like.

The glass flakes may be coated with a metal, such as by the non-electrolytic plating method. If this metal is silver, then 'Metashine REFSX-2015PS', 'Metashine-2025PS' and 'Metashine-2040PS' are examples that are employable herein as the glass flake pigment and are all the products made by the Toyo Aluminum Co., Ltd.

The glass flakes may be coated with a metal alternatively by the sputtering method. If the metal is silver, then 'Crystal-Color GF-2125', 'Crystal-Color-2125M', 'Crystal-Color-2140' and 'Crystal-Color-2140M' are proper examples, all being the products of the Toyo Aluminum Co., Ltd. The Toyo Aluminum's 'Crystal-Color GF-2525', 'Crystal-Color-2525M', 'Crystal-Color-2540' and 'Crystal-Color-2540M' are suitable examples coated with a nickel-chromium-molybdenum alloy. The other products usable herein and made by that company are: 'GF-250' coated with a brass, 'GF-1345' coated with a silver alloy and 'GF-1445' coated with titanium.

Median diameter of glass flake pigment preferably falls within a range from 5.0 μm to 40 μm. If the diameter is less than 5.0 μm, then excessively small flakes will impair brilliancy. If, however, the diameter exceeds 40 μm, then the pigment will not be able to flow through a nib of the ball-point pen.

Metal-Coated Inorganic Pigment.

The pigment of this type usable as the brilliant pigment is coated with a metal or a metal oxide layer formed exemplarily by the metal vapor deposition method. Examples are aluminum powders each coated with iron (III) oxide, such as 'Paliocrom Gold L2000/L2002', 'Paliocrom Gold L2020/L20222', 'Paliocrom Gold L2025', and 'Paliocrom Orange L2800', all from the BASF GmbH. Mica coated with iron (III) oxide are 'Paliocrom Red Gold L2500' and 'Paliocrom Red L4000', both from the said company. Mica-like iron (III) oxide coated with an aluminum-manganese alloy such as 'Paliocrom Copper L3000' and 'Paliocrom Copper L3001' made by the said company are also employable. Mica coated with a reduced titanium oxide such as 'Paliocrom Blue Silver L6000' and 'Paliocrom Blue Silver L6001' of the said company, as well as mica coated with a normal titanium dioxide are employable as well.

Median diameter of these inorganic pigments may also preferably be from 5.0 μm to 40 μm. If the diameter is less than 5.0 μm, then excessively small flakes will impair brilliancy. If, however, the diameter exceeds 40 μm, then the pigment will not be able to flow through a nib of the ball-point pen.

Preferably, content of the metal-coated inorganic pigment may be from 1.0 to 20.0% by weight of the ink composition. If the content is less than 1.0%, then the ink will give an insufficient brilliancy. If the content exceeds 20.0%, then an excessively high viscosity will impair flowability of the ink. Thus, an optimal content of this pigment is 2.0–10.0% by weight of the ink.

Metallic-Luster Pigments.

An aluminum powder, a brass powder, a copper powder, a gold powder and a silver powder are usable as this type pigment. The aluminum powder may be of the leafing type or of the non-leafing type, such as 'AL-PASTE WJP-U75C', 'AL-PASTE WE-1200', 'AL-PASTED WXM-7675' and 'AL-PASTE WXM-0630'(all being the products of the Toyo Aluminum Co., Ltd.), '1110W' and '2172SW' (both from the Showa Aluminum Co., Ltd.), and 'AW-808C' and 'AW-7000R' (both from the Asahi Chemical Industries Co., Ltd.). In addition, some colored aluminum pigments such as 'F500RG', 'F500BG-W' and 'F701RE-G' are also usable herein.

Examples of brass powder pigments as the other type metallic-luster pigment are: 'BS-605' and 'BS-607' (from the Toyo Aluminum), 'Bronze Powder P-555' and 'Bronze Powder P-777' (from the Nakajima Metallic Powders Co., Ltd.).

Any one of these pigments may be used alone, or any two or more of them may be used in combination. In any case, median diameter of each metal powder pigment is preferably from 5 μm to 30 μm.

Pearl-Glossy Pigments.

Examples of this type pigments are the 'Iriodin' series accompanied by the suffixes: 100, 103, 111, 120, 123, 151, 153, 163, 173, 201, 211, 221, 223, 231, 205, 215, 217, 219, 225, 235, 249, 259, 289, and 299. Other examples are the 'Timiron MP' series accompanied by the suffixes: 115, 1001, 47, 1005, 10 and 45SP. Another example is 'Extender W', and all the foregoing are code names for the products made by the Merck Japan Ltd.

An ink containing this type of pigment will be afforded a variety of hues by pearl-glossy pigments described above added with some known dyes or carbon black.

Examples of the colored type pearl-glossy pigments are the 'Iriodin' series accompanied by the suffixes: 300, 302, 303, 306, 309, 320, 323, 351, 355, 500, 502, 504, 505, 507, 520, 522, 524, 530, 532, and 534. Further examples are: 'Timiron MP-25', 'Timiron-20', 'Corona Bronze', 'Corona Light Blue' and 'Corona Platina Silver'. All the foregoing codes are trade names for the products made by the Merck Japan Ltd., and these pigments will afford a variety of hues to highly light-resistant and waterproof inks containing the same.

An average diameter of the particles of each of these pigments may preferably be from about 5 μm to 60 μm, and more desirably 5–40 μm.

Water-Soluble Resins.

It is highly desirable herein to use a water-soluble resin as one ingredient of the ink, in order to effectively adjust the ink's viscosity, facilitate the glass flake pigment to be dispersed in the ink and protect the same from deposition. For example, any of proper microbial polysaccharides and derivatives thereof, such as 'pluran', xanthan gum, welan gum, rhamsan gum, succinoglucan, or dextran; may be used. Also, water-soluble vegetable polysaccharides and their derivatives, such as tragacanth gum, guar gum, tara gum, locust bean gum, ghatti gum, arabinogalactan gum, Arabic gum, quince seed gum, pectin, starch, psyllium seed gum, carrageenan, alginic acid, agar and the like, are usable. Further, water-soluble animal polysaccharides and derivatives, such as gelatin, casein and albumin, are also employable.

Particularly adapted for use herein are the microbial polysaccharides and their derivatives. Any one of these pigments listed above may be used alone, or any two or more of them may be used in combination. Water-Soluble Organic Solvents.

It also is important herein that the water-soluble solvents noted above are such as protecting the penpoint tip from drying and also as protecting the ink from freezing. The water-soluble solvent is one of the group comprising a) alcohols with carbon number from 1 to 10, b) glycols comprising ethylene glycol, diethylene glycol, triethylene glycol, propylene glycol, hexene glycol, polyethylene glycol, or glycerol and c) ethylene-glycol monomethylether, diethyleneglycol monomethylether, dipropyleneglycol monomethylether dipropyleneglycol monomethylether, or a mixture of at least two of said groups. Examples of appropriate solvents are alcohols, glycols and glycol ethers, and in detail, the glycols may be: hexylene glycol, ethylene glycol, diethylene glycol, triethylene glycol, propylene glycol, polyethylene glycol, glycerol and the like. Proper glycol ethers may be: ethyleneglycol monomethylether, diethyleneglycol monomethylether, dipropyleneglycol monopropylether, dipropyleneglycol monomethylether and the like. Any one of these solvents exemplified here may be used alone, or any two or more of them may be used in combination.

Preferably, content of the water-soluble organic solvent may be from 1.00 to 40.0% by weight of the ink composition. If the content is less than 1.00%, then the penpoint is likely to dry and the ink is likely to freeze. If, however, this contents exceeds 40.0%, then it will adversely affect dissolution of the water-soluble resin, rendering the writings or membranes formed of such an ink difficult to dry. An optimal content of the solvent or solvents is from 5.00 to 20.0% by weight of the ink, though it may some what differ between the kinds of solvents within this range.

Colorants.

The colorants used herein may be soluble or dispersible. Preferable examples are: water-soluble dyes including acid dyes, direct dyes, basic dyes and the like; organic or inorganic pigments including phthalocyanin, quinacridon, carbon black and the like; fluorescent pigments; resin emulsions colored with a suitable dye or pigment. A dispersion of such a pigment may be blended with the ink composition, or mixture of any colorant listed above with any brilliant pigment such as an aluminum pigment, pearl-glossy pigment or the like may also be employed. The metal-coated inorganic pigment mentioned above may be used in combination with the glass flake pigment.

Preferable content of the colorant is from 0.05 to 15.0% by weight of the ink composition. If the content is less than 0.05%, then it will be difficult to visually sense the hue of this colorant. If, however, this content exceeds 15.0%, then the ink will be too viscous to ensure a good flowability thereof. An optimal content of the colorant or colorants is 1.00–10.0% by weight of the ink, though it may somewhat vary between the kinds of colorants within this range.

Usually, dyes are used as the colorants, because they will rapidly diffuse into the surface to which the ink is applied. Any conventional dyes known in the art may be used in their natural or unmodified state, insofar as they show no trouble when dissolved or dispersed in the solvent. Any pigments that are of a nature similar to the dyes in this regard may also be employed.

Suitable dyes include: metal-complex dyes; acid dyes such as benzene azoic dyes, pyrazolone azoic dyes, acetoacetic-anilide azoic dyes, naphthalene-derivative azoic dyes, deep-color-developing disazo dyes, highly-efficient disazo dyes, quinizarin dyes, bromoamine dyes, anthraquinone dyes, nitro dyes or the like; direct dyes such as copper-phthalocyanine dyes, benzine dyes, tolidine dyes, dianilidine dyes, stilbene diazo dyes, diazo dyes each having a urea bond, azoic dyes each having a coupling group, diamine-diphenylamine azoic dyes, polyazoic dyes each having azo groups in series, other polyazoic dyes, thiazole azo dyes, sulfonated pigments and the like; and, basic dyes such as diphenyl-methane dyes, triphenyl-methane dyes, acridine dyes, di-(tri-)allyl methane dyes, quinonimine dyes, xanthene dyes, azoic dyes, polymethine dyes, azomethine dyes, diazomethine dyes, diazotrimethine dyes, triazotrimethine dyes, triazole-azo dyes, thiazole-azo dyes, benzothiazole-azo dyes.

Usable pigments are phthalocyanine, dioxadine, carbon black and the like, inclusive of fluorescent pigments.

Any of these colorants may be used alone, or two or more of them may be used in combination. Any auxiliary agents may be added to any of the described aqueous inks if necessary, and these agents include slip additives, anticorrosion agents, anti-septic anti-mildew agents, and various kinds of surfactants. The slip agents may be alkali metal salts of polyoxyethylene, amides of dicarboxylates, esters of phosphoric acid, salts of N-oleyl sarcosine, or the like. The anticorrosion agents may be benzotriazole, tolyltriazole, dicyclohexyl ammonium nitrate or the like. The antiseptic agents may be benzoisothiazoline, pentachloro-phenols, or cresol-based agents. Proper stabilizers may also be added to the ink, if necessary, for thickeners. The stabilizer may be the sodium salt of a carboxylic acid, such as benzoic acid.

Although viscosity from 3 to 4,000 mPa·S have been suited for the prior art ball-point pens, it is now expected that the ball-point pen filled with an aqueous ink of a much higher viscosity of from 4,000 to 35,000 mPa·S can now work well. These values of viscosity were measured using an ELD type viscometer made by the TOKIMEC Co., Ltd. with a 3° cone 'R14' rotating at 0.5 rpm, at 20° C.

Now some embodiments will be described in detail referring to the drawings.

A ball-point pen 1 in a preferred embodiment of the present invention comprises a cylindrical penholder 2 and an ink cartridge or pen body 3. This ink cartfidge 3 comprises a writing ball 10 rotationally held in a penpoint tip 5, with this tip being connected by a joint 6 to the distal end of an ink reservoir 7, A spherical valve 8 is disposed in the joint 6.

The penpoint tip 5 has a distal end in which a writing ball 10 is retained in a distal end thereof. This tip may be formed by machining or cutting a free-cutting stainless steel, a brass, a German silver or the like.

As seen also in FIG. 1, the interior of the penpoint tip is such that a ball chamber holds therein the writing ball 10. An ink feed bore 12 extends through the penpoint tip so as to continue rearwardly from said chamber to open at the rear or proximal end of said tip.

An increased-diameter portion 13 is formed adjacent to the rear end of the ink feed bore 12, with a valve support (viz., valve stopper) 15 being formed therein.

The writing ball 10 kept in position in the ball chamber of the penpoint tip 5 is capable of rotating therein. This writing ball 10 in the ball-point pen of this embodiment is a sintered article of silicon carbide, and has usually a diameter of from about 0.4 mm to about 1.2 mm.

A sintered mass of silicon carbide may be processed to be of a spherical shape and then its round surface may be polished to give the writing ball 10 a finished mirror-like surface. This process may be conducted to form in the ball's spherical surface a number of fine pores preferably of average diameter of from 1 to 10 $\mu$m and distributed all over said surface. In detail, the raw sintered mass was severed into pieces of a proper size, and then each irregular piece as the raw material of each writing ball 10 may be ground with a diamond whetstone into the spherical shape, before being chemically etched to have the finished mirror surface. The fine pores may be natural voids originating from the raw sintered mass, or may be formed due to removal of additives that may have been present therein, during the grinding with diamond whetstone or during the chemical etching.

The writing ball 10 thus finished to have the mirror surface may be used as it is, though it is possible to further process it in a tumbler so as to chamfer the circular edge around each fine pore. The tumbler may comprise a drum in which the writing balls collide with each other so that not only the said acute edge of each pore is rounded in each ball but also any unstable foreign substance is removed therefrom to thereby afford a durable good writing property.

The joint 6, that is made by injection molding a polypropylene or the like thermoplastic resin, is of the shape similar to those known and conventional in this field. Thus, it has a conical distal portion 20 and a stepped and cylindrical proximal portion composed of a larger diameter part 21 and a smaller diameter part 22. A bore 23 penetrates an axial portion of this joint 6, and valve seat 25 is formed therein and disposed intermediate the front and rear ends of the bore. A positioning annular step 31 also formed in this bore 23 is located ahead of said seat and nearer the distal end of joint.

The spherical valve 8 is a ball made of a corrosion-proof material of a relatively high specific gravity, such as a stainless steel, a hard alloy or a ceramics.

The ink reservoir (i.e., ink holder) 7 is a cylinder made by extruding a polyethylene, a polypropylene or the like resin so as to be filled with the aqueous ink 30 containing a glass flake pigment, which was the 'Metashine REFSX-2040PS' in this embodiment.

The brilliant ink 30 employed in this embodiment had a viscosity of 7000 mPa¥S (by the ELD type viscometer with a 3° cone 'R14' rotating at 0.5 rpm, at 20° C.).

The pen body or cartridge 3 comprises the penpoint tip 5 and the ink reservoir 7 fixedly connected thereto by the joint 6. This tip 5 fits in the distal region of bore 23 formed in the joint 6, and the reservoir 7 fits on the smaller diameter part 22 that is formed as the proximal region of said joint. The valve 8 interposed between the valve support 15 in penpoint tip 5 and the valve seat 25 in joint 6 is movable fore and aft between them in an axial direction. Fitted on the larger diameter part 21 of the joint 6 constituting the pen body 3 is the penholder 2.

Writing tests were carried out to evaluate the writing property of the ballpen of this embodiment, to find that smooth writings were made without suffering from blurs or broken lines in spite of the relatively high viscosity of the ink. Its durability did prove good, showing the good writing property even after a long period of storage of the pen.

In summary, the ball-point pen of the present invention works comfortably and ensures smooth and unbroken lines in writings, by virtue of the writing ball formed of a sintered silicon carbide or the like which compensates for the described drawback that would otherwise be caused by the aqueous ink whose viscosity is considerably high due to the glass flake pigment.

What is claimed is:

1. A ball-point pen comprising a. a penpoint tip, b. a writing ball rotationally held in the penpoint tip and c. an ink reservoir whose distal end is connected to the penpoint tip, wherein the writing ball is formed of a sintered inorganic material having a surface layer comprising fine holes that have a median diameter of from about 1 to about 20 $\mu$m, and the ink reservoir is filled with an aqueous ink containing a glass flake pigment and having a viscosity of about 4,000 to about 30,000 mPa·S.

2. A ball-point pen as defined in claim 1, wherein said sintered inorganic material is selected from the group consisting of a sintered silicon carbide, a sintered zirconia, a sintered alumina and a sintered carbon nitride.

3. A ball-point pen as defined in claim 1, wherein said glass flake pigment comprises a glass flake coated with one or more of the group of gold, silver, copper, brass, titanium, nickel, chromium and molybdenum, and/or one or more of the group of bismuth, antimony and arsenic, and its median diameter is from about 5 to about 40 $\mu$m, and it is contained in the aqueous ink by weight or about 0.5 to about 20.0% in its composition.

4. A ball-point pen as defined in claim 1, wherein the aqueous ink contains a glass flake pigment and one or more of a) brilliant pigments whose particles are coated with metal and/or metal oxide, b) metal-luster pigments composed of metal powder, c) peal-glossy pigments and d) white pigments.

5. A ball-point pen as defined in claim 4, wherein the brilliant pigment is composed at least one of the group comprising a) aluminum powders coated with iron (III) oxide, b) mica coated with iron (III) oxide, c) mica-like iron (III) oxide coated with an aluminum-manganese alloy and d) mica coated with a titanium dioxide, and its median diameter is from about 5 to about 40 $\mu$m.

6. A ball-point pen as defined in claim 4, wherein the metal powder is at least one of the group comprising an aluminum powder, a brass powder, a copper powder, a gold powder and a silver powder.

7. A ball-point pen as defined in claim 4, wherein the brilliant pigment is one of the group comprising a) an aluminum powder coated with iron (III) oxide, b) mica coated with iron (III) oxide, c) mica-like iron (III) oxide coated with an aluminum-manganese alloy and d) mica coated with a titanium dioxide, and its median diameter is from about 5 to about 40 $\mu$m, and metal powder is at least one of the group comprising an aluminum powder, a brass powder, a copper powder, a gold powder and a silver powder.

8. A ball-point pen as defined in claim 4, wherein said white pigment comprises titanium dioxide powder.

9. A ball-point pen as defined in claim 1, wherein said glass flake pigment comprises glass flakes coated with one or more of the group of gold, silver, copper, brass, titanium, nickel, chromium and molybdenum, and/or one or more of the group of bismuth, antimony and arsenic, and its median diameter is from about 5 to about 40 $\mu$m, and it is contained in the aqueous ink by weight of about 0.5 to about 20.0% in its composition, andthe aqueous ink contains a glass flake pigment and one or more of a) brilliant pigments whose particles are coated with metal and/or metal oxide, b) metal-luster pigments composed of metal powder, c) peal-glossy pigments and d) white pigments.

10. A ball-point pen as defined in claim 1, wherein the aqueous ink comprises a water-soluble resin, a water-soluble organic solvent, at least one colorant, and water.

11. A ball-point pen as defined in claim 10, wherein the aqueous ink contains from about 0.01 to about 40.0% by weight of the water-soluble resin in the composition, and said water-soluble resin is at least one of the group comprising a) microbial polysaccharides and derivatives thereof, b) water-soluble vegetable polysaccharides and derivatives thereof, and c) water-soluble animal polysaccharides and derivatives thereof.

12. A ball-point pen as defined in claim 11, wherein said microbial polysaccharides and derivatives thereof are selected from pluran, xanthan gum, welan gum, rhamsan gum, succinoglucan, and dextran; said vegetable polysaccharides and derivatives thereof are selected from tragacanth gum, guar gum, tara gum, locust bean gum, ghatti gum, arabinogalactin gum, arabic gum, quince seed gum, pectin, starch, psyllium seed gum, carrageenan, alginic acid, and agar; and said animal polysaccharides and derivatives thereof are selected from gelatin, casein and albumin.

13. A ball-point pen as defined in claim 10, wherein the aqueous ink contains from about 1.0 to about 40.0% by weight of a water-soluble solvent, and said water-soluble solvent is one of the group comprising a) alcohols with carbon number from 1 to 10, b) glycols comprising ethylene glycol, diethylene glycol, triethylene glycol, propylene glycol, hexene glycol, polyethylene glycol, or glycerol and c) ethylene-glycol monomethylether, diethyleneglycol monomethylether, dipropyleneglycol monopropylether, dipropyleneglycol monomethylether, or a mixture of at least two of said groups.

14. A ball-point pen as defined in claim 10, wherein the aqueous ink contains from about 0.05 to about 15.0 by weight of colorant, and said colorant comprises at least one of the group comprising a) water-soluble dyes; b) organic pigments; c) inorganic pigments; d) fluorescent pigments; e) resin emulsions colored with a dye or pigment) mixtures of brilliant pigments comprising an atuninum pigment, pearl-glossy pigment or the like; and g) mixtures of metal-coated inorganic pigments with glass flake pigments.

15. A ball-point pen as defined in claim 14, wherein the water-soluble dye is selected from acid dyes, direct dyes, and basic dyes; the organic pigment is selected from phthalocyanin or quinacridon; and the inorganic pigment comprises carbon black.

* * * * *